US005104017A

United States Patent [19]

Vandagriff

[11] Patent Number: 5,104,017

[45] Date of Patent: Apr. 14, 1992

[54] SKI CADDY

[76] Inventor: Craig Vandagriff, 24637 Gardenstone La., West Hills, Calif. 91307

[21] Appl. No.: 774,569

[22] Filed: Oct. 9, 1991

Related U.S. Application Data

[63] Continuation of Ser. No. 537,058, Jun. 12, 1990, abandoned.

[51] Int. Cl.[5] ..... A63C 11/02

[52] U.S. Cl. ..... 224/205; 224/250; 224/917; 280/814; 294/147

[58] Field of Search ..... 224/202, 205, 250, 251, 224/257, 901, 913, 917; 383/97; 280/814, 815; 294/147, 157, 148-152; 150/154

[56] References Cited

U.S. PATENT DOCUMENTS

| | | | |
|---|---|---|---|
| 2,118,875 | 5/1938 | Windheim | 294/147 X |
| 3,336,961 | 8/1967 | Welsh | 294/147 |
| 3,948,302 | 4/1976 | Kohns | 280/814 |
| 4,114,838 | 9/1978 | Knauf | 280/814 X |
| 4,191,233 | 3/1980 | McKay | 280/814 X |
| 4,456,284 | 6/1984 | Saka | 280/814 X |
| 4,518,107 | 5/1985 | Amos | 224/917 X |
| 4,658,999 | 4/1987 | Hilty | 224/202 |
| 4,676,417 | 6/1987 | Hirschkoff | 224/202 |
| 4,903,875 | 2/1990 | Smart et al. | 224/205 X |
| 5,022,678 | 6/1991 | Mayfield | 280/815 |

FOREIGN PATENT DOCUMENTS

| | | | |
|---|---|---|---|
| 2265424 | 11/1975 | France | 280/814 |

*Primary Examiner*—Henry J. Recla
*Assistant Examiner*—Casey Jacyna
*Attorney, Agent, or Firm*—Poms, Smith, Lande & Rose

[57] ABSTRACT

A ski caddy comprising a combined carry case for skis and a bag for the case. The case is elongated and flexible with an elastic midportion and a pocket at one end for receiving the curved tips of the skis and a pocket at the other end for receiving the rear end of the skis. The elastic midportion accommodates the case to the length of the skis. Straps are provided for carrying the caddy and the pocket for receiving the curved tips of the skis is integral with a bag into which the case can be inserted for carrying when not in use.

7 Claims, 1 Drawing Sheet

SKI CADDY

RELATIONSHIP TO COPENDING APPLICATIONS

This application is a continuation of application Ser. No. 07/537,058 filed June 12, 1990, now abandoned.

BACKGROUND OF THE INVENTION

1. Field of the Invention

The invention relates to a ski caddy; and, particularly, to a carrying case for skis.

2. Description of the Prior Art

Skiing is quite a popular pastime. Skiers generally ride on motorized elevated cable transported chairs to the top of slopes or the like. Such chairs have seats in which the skier sits and carries his or her skis. This is awkward and cumbersome. Also, the skiers must carry their skis back and forth to such slopes. There is a need for a ski caddy that can carry a pair of skis, yet the caddy has its own bag into which the case for the skis can be transported when not in use.

SUMMARY OF THE INVENTION

It is an object of this invention to provide a ski caddy for transporting a pair of skis.

It is a further object of this invention to provide a carrying case for a pair of skis having a bag into which the case can be placed when not in use.

It is still another object of this invention to provide a ski caddy which can accommodate itself to skis of varying lengths.

These and other objects are preferably accomplished by providing a ski caddy comprising a combined carrying case for skis and a bag for the case. The case is elongated and flexible with an elastic midportion and a pocket at one end for receiving the curved tips of the skis and a pocket at the other end for receiving the rear flat ends of the skis. The elastic midportion accommodates the case to the length of the skis. Straps are provided for carrying the caddy and the pocket for receiving the curved tips of the skis is integral with a bag into which the case can be inserted for carrying when not in use.

DESCRIPTION OF THE PREFERRED EMBODIMENT

Figures 1, 2, 3, 4, 5, 6:
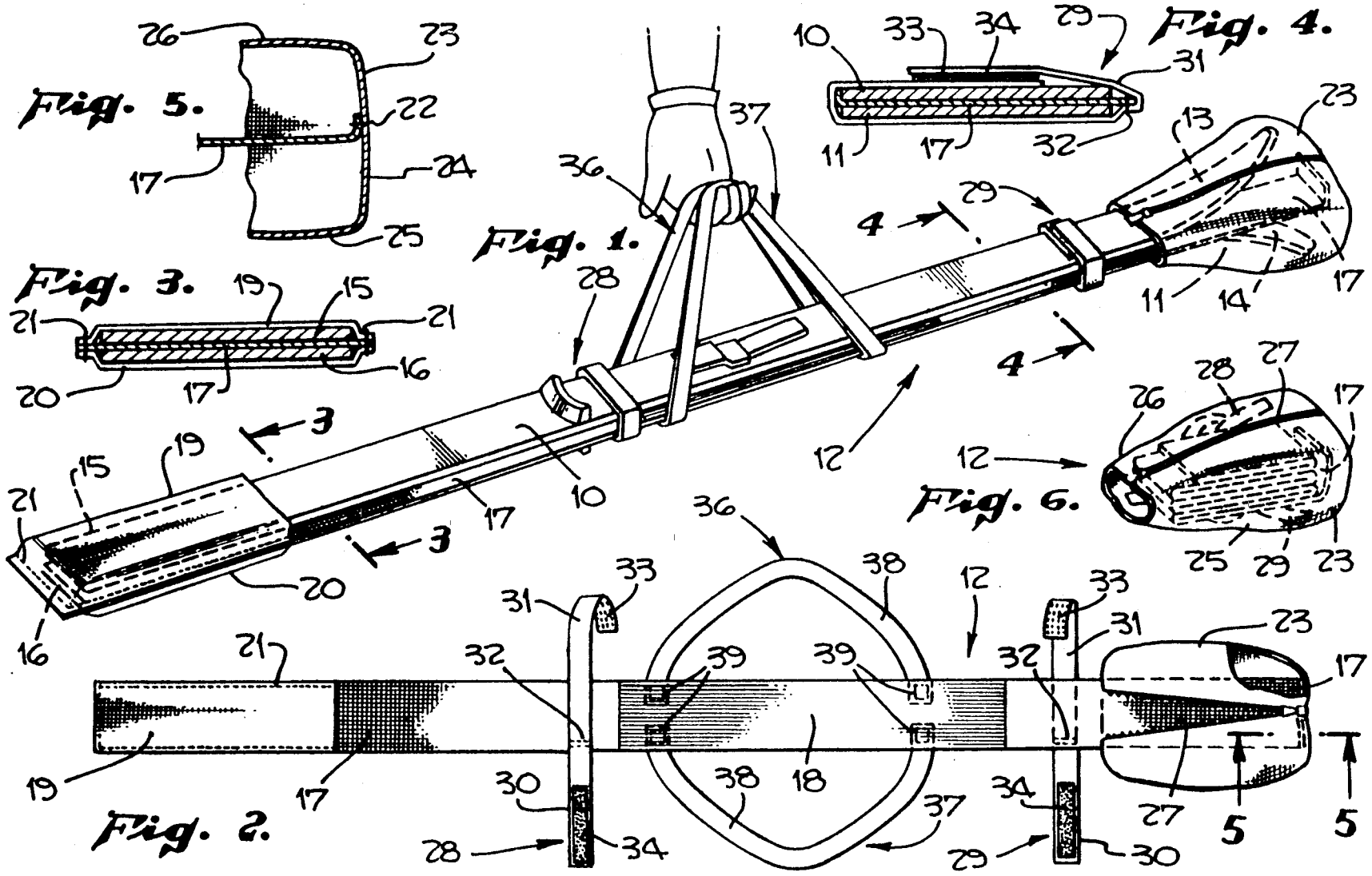
FIG. 1 is a perspective view of a ski caddy having a pair of skis carried thereby in accordance with the teachings of the invention.
FIG. 2 is a top plan view of the caddy alone of the invention.
FIGS. 3 and 4 are views taken along lines 3—3 and 4—4, respectively, of FIG. 1.
FIG. 5 is a view taken along lines 5—5 of FIG. 2.
FIG. 6 is a perspective view of the ski caddy of FIG. 2 stored in its bag.

Referring now to FIG. 1 of the drawing, a pair of skis 10, 11 are shown stored in a ski caddy 12 in accordance with the invention. Each ski 10, 11 has a generally flat elongated main body portion with an upwardly curved end 13, 14, respectively, and a generally flat rear end 15, 16, respectively (see also FIG. 3).

As seen in FIG. 2, the ski caddy 12 includes a main elongated body portion 17 with a generally elastic midportion 18. A pair of elongated pockets 19, 20 (see also FIG. 3) are provided at one end. Body portion 17 may be a single layer of a flexible material, such as nylon (except for elastic midportion 18) with pockets 19, 20 formed by stitching 21. That is, as seen in FIG. 3, the body portion 17 has an elongated piece of material, similar to the material of portion 17, stitched or otherwise secured on each side thereof to form pockets 19, 20 on each side of body portion 17.

As seen in FIG. 5, body portion 17, at the end opposite pockets 19, 20, extends into and is secured, as by stitching 22, to a bag 23. Bag 23 is comprised of a piece of material having a bag 24 and interconnected sides 25, 26. As seen in FIG. 6, sides 25, 26 are interconnected to form a pocket closed by a zipper 27.

A pair of strap assemblies 28, 29 (FIG. 2) are provided adjacent each end of ski caddy 12 before the terminal ends thereof. Each strap assembly 28, 29 includes a pair of straps 30, 31 secured via stitching 32 or the like to body portion 17. The terminal ends of each strap includes a mating part of conventional hook and loop material, such as hook end 33 and loop end 34.

Carrying straps 36, 37 are provided having a first strap 36 stitched or otherwise secured to main body portion 17 at stitching 39 at the bottom of body portion 17 at spaced locations along one side thereof. A second strap 37 is also stitched or otherwise secured to main body portion 17 at stitching 39 at the bottom of body portion 17 at spaced locations along one side thereof opposite strap 36. Straps 36, 37 thus have body portions 38 which meet when straps 36, 37 are in the FIG. 1 position.

As seen in FIG. 6, the portion of ski caddy 12 other than bag 23 can be rolled up and inserted into bag 23 with zipper 27 closed so that the entire ski caddy 12 can be easily transported.

When it is desired to use ski caddy 12 to transport a pair of skis, bag 23 is opened via zipper 27 and ski caddy 12 is opened to the FIG. 2 position.

The rear flat ends 15, 16 of each ski 10, 11 is inserted into pockets 19, 20, respectively (FIGS. 1 and 3), and the front curved ends 13, 14 of each ski 10, 11 are inserted into bag 23 on opposite sides of body portion 17 (FIG. 5) and curving in opposite directions as seen in FIG. 2. Each strap assembly 28, 29 is now secured about the skis 10, 11 and the mating hook and loop ends 33, 34 are connected, as seen in FIGS. 2 and 4, to secure the caddy 12 to skis 10, 11. Bag 23 is zippered shut and straps 36, 37 are used to carry the skis. The straps 36, 37 may be of a length to enable the skis to be carried over one's shoulder and may be of any suitable material.

The ski caddy 12 can be made of varying lengths, such as 3', 5' and 7', to accommodate the general lengths of conventional skis. The elastic midportion 18 allows the ski caddy 12 to compensate for varying ski lengths within the predetermined conventional lengths for caddy 12. For example, midportion 18 may stretch up to 7" or so.

It can be seen that I have disclosed a simple and inexpensive ski caddy for transporting a pair of skis in a safe and easily transportable manner. The ski caddy can be made of inexpensive materials and stitched or otherwise put together in an economical manner.

I claim:

1. A ski caddy for transporting a pair of skis consisting solely of an elongated piece of single ply planar material having a first pair of pockets integral with one end thereof, one of said pockets being disposed on one side of said piece and the other of said pockets being disposed on the other side of said piece, a second pair of pockets being disposed on the other end of said piece and integral therewith, said second pair of pockets being provided by a zippered bag having an open end into which said piece extends and is connected thereto, each of said second pair of pockets having an internal capacity greater than each of said first pair of pockets and adapted to accommodate curved ends of a pair of skis therein whereby said piece and said first pair of pockets can be placed into said bag for transporting the same, each of said second pockets being disposed on opposite sides of said piece whereby said first pair of pockets and the portion of said piece normally extending out of said bag can be rolled up for storage inside of said bag.

2. In the ski caddy of claim 1 including a pair of strap assemblies adjacent each of said first and second pair of pockets.

3. In the ski caddy of claim 2 wherein each of said strap assemblies includes a pair of straps, each of said straps having one end secured to said piece and a terminal end having a releasable mating portion adapted to releasably connect to a mating portion on the other of said straps.

4. In the ski caddy of claim 1 wherein said piece includes an elastic midportion generally midway between said first and second pair of pockets.

5. In the ski caddy of claim 1 including a carrying strap assembly secured to said piece.

6. In the ski caddy of claim 5 wherein said carrying strap assembly includes a pair of elongated straps, said elongated strap including one end secured to said piece on the bottom thereof along one side thereof and the other end also secured to said piece on opposite sides of each other.

7. In the ski caddy of claim 1 wherein said piece and said pockets are of nylon material.

* * * * *